United States Patent [19]

Schroeder

[11] 4,027,422

[45] June 7, 1977

[54] MODEL AIRCRAFT PROPULSION

[76] Inventor: Lloyd A. Schroeder, 5391 Robinwood Drive, North Street, Mich. 48049

[22] Filed: Mar. 22, 1976

[21] Appl. No.: 668,828

Related U.S. Application Data

[63] Continuation-in-part of Ser. No. 617,790, Sept. 29, 1975, Pat. No. 3,999,328, which is a continuation-in-part of Ser. No. 422,688, Dec. 7, 1973, Pat. No. 3,908,305.

[52] U.S. Cl. ..... 46/78; 46/86 B

[51] Int. Cl.[2] ..... A63H 27/00; A63H 33/20

[58] Field of Search ..... 46/76 R, 78, 81, 86

[56] References Cited

UNITED STATES PATENTS

| | | | |
|---|---|---|---|
| 1,836,319 | 12/1931 | Gehrung | 244/54 |
| 2,568,475 | 9/1951 | Vaughn | 46/86 C |
| 3,067,973 | 12/1962 | Halsey et al. | 244/140 |
| 3,204,368 | 9/1965 | Effinger et al. | 46/78 |
| 3,292,302 | 12/1966 | Estes et al. | 46/74 C |
| 3,699,708 | 10/1972 | Mabuchi | 46/76 |
| 3,777,420 | 12/1973 | Bosley et al. | 46/78 |

*Primary Examiner*—Louis G. Mancene
*Assistant Examiner*—Robert F. Cutting
*Attorney, Agent, or Firm*—Harness, Dickey & Pierce

[57] ABSTRACT

A power pod is releasably coupled with a model aircraft, such as a model glider plane, to initially power the aircraft into flight and to thereafter separate from the aircraft under the influence of gravity. In the preferred embodiments of the invention, an adaptor element is affixed to the underside of the model aircraft fuselage, and the power pod itself is releasably coupled with the adaptor. The releasable coupling of the power pod with the adaptor is structured such that the power pod remains coupled with the adaptor to thereby power the model aircraft into flight as long as the power pod is providing a forward thrust. In one embodiment, the power pod separates from the adaptor when operation of the power pod ceases; in another embodiment, the power pod remains coupled with the adaptor after operation of the power pod ceases with the pod separating from the adaptor upon command of a remote control radio signal. Upon separation of the power pod from the adaptor, a parachute stored within the pod is deployed by means of a rip cord connected at one end to the model aircraft. The rip cord includes a replaceable, breakable link which breaks as the pod and the deployed parachute fall away from the model aircraft. The cord may have a member on the end which has releasable frictional engagement with the parachute. The power pod includes an adjustable engine mounting plate for permitting the angle of thrust to be established at optimum inclination. The adaptor includes a layer of deformable, reslient material which permits the adaptor to mount without modification to different fuselage configurations. The parachute is attached to the power pod in such a way that the power pod lands in an orientation which minimizes any risk of damage to the pod upon impact with the ground.

10 Claims, 27 Drawing Figures

MODEL AIRCRAFT PROPULSION

RELATED APPLICATIONS

This is a continuation-in-part application of application Ser. No. 617,790, filed Sept. 29, 1975 now U.S. Pat. No. 3,999,328, Dec. 28, 1976 which is a continuation-in-part application of U.S. Pat. No. 3,908,305, issued Sept. 30, 1975.

BACKGROUND AND SUMMARY OF THE INVENTION

The present invention pertains generally to model aircraft and, more particularly, to a model aircraft power pod which is releasably coupled with the model aircraft to initially power the model aircraft into flight and thereafter separate from the model aircraft.

Model aircraft enthusiasts, in particular, model glider plane enthusiasts, have for a long time been confronted with the problem of making their model aircraft airborne. Up to now, various launching or take-off techniques have been tried, but these in general suffer from various limitations and possess undesirable features. For example, one already-known technique involves the use of a tow cable, one end of which attaches to a tow hook on the model aircraft. The cable extends for an appreciable distance along the ground, and the other end of the cable connects to a winch. The winch operates to wind up the cable and thereby cause the model aircraft to become air-borne after which time the cable is disconnected from the aircraft. This technique has at least several serious disadvantages. First, a relatively long, flat strip of ground, for example, several hundred feet, is required for set-up of the tow cable prior to take-off. Obviously, this involves the expenditure of a lot of time and energy for the set-up procedure. Second, since it is usually necessary that the model aircraft take off into the wind, the direction in which the tow cable is laid out is critical. If the wind should shift after the cable has been laid out, the operator must reorient the cable, assuming, of course, that the geographical terrain in the take-off area permits the cable to be conveniently reoriented. Needless to say, this procedure can at times try the patience of even the most devoted model aircraft enthusiast.

Another type of take-off arangement has been proposed in U.S. Pat. No. 3,452,471 wherein a model stick glider is propelled into the air by means of a rocket motor pod. Although this arrangement is alleged to be capable of attaining vertical take-off, it has it own limitations and undesirable characteristics. One significant disadvantage is that an explosive ejection charge must be ignited to provide a rearward thrust to separate the rocket pad from the glider. Furthermore, the coupling between the rocket pad and the stick glider requires that the pod be bodily displaced upwardly and rearwardly relative to the stick glider before separation can occur.

The present invention is directed to a novel power pod for model aircraft, especially model glider planes, which overcomes the disadvantages of the prior technques heretofore used in powering model aircraft into flight. With the present invention, a power pod is releasably coupled with a model glider to power the glider into flight and to thereafter separate from the glider by force of gravity without the need of any separate ejection charge and without the act of separation creating any undesired disturbance on the flight of the glider. Geographical considerations and wind direction are not critical, since the operator can easily aim the model aircraft in any desired heading at the time of takeoff. The power pod can be arranged to separate from the glider eithr upon exhaustion of the fuel supply contained within the power pod or at a later time upon command of a remote control radio signal. According to the preferred embodiments of the present invention, an adaptor element is fixedly attached to the glider fuselage, and the power pod itself is releasably coupled with the adaptor. An advantage of the adaptor is that it can accommodate a variety of different fuselage shapes without modification. Thus, the invention has the advantage of utility with a large number of currently available model aircraft. As a further feature, the invention provides a mounting arrangement for the engine on the pod which permits the direction of thrust to be set to an optimum angle relative to the glider fuselage. A still further feature of the invention resides in positive deployment of a parachute from the pod which is effected by means of a rip cord having a replaceable, breakable link. Such positive deployment of the parachute ensures that the pod safely descends to earth. The parachute is so attached to the pod that the pod descends in an orientation which substantially minimizes the risk of damage to the pod upon impact with the ground. The invention can be practiced with a variety of propulsion sources, although a small single-cylinder engine and propeller are preferably used. Several components of the preferred embodiments of the invention can be advantageously constructed from molded plastics thereby providing economical manufacture and ease of assembly.

As a result of the present invention, the model aircraft enthusiast is relieved of the complicated procedures and the limitations of the prior art arrangements. Accordingly, the present invention promotes maximum enjoyment for the model aircraft enthusiast in his hobby and removes the possibility of his being frustrated by the complicated and cumbersome set-up procedures.

The foregoing features and advantages of the invention, along with additional features and advantages, will be seen in the ensung descripton and claims which are to be taken in conjunction with the accompanying drawings. The drawings illlustrate preferred embodiments of the invention in accordance with the best mode presently contemplated for carrying out the invention.

DESCRIPTION OF THE PREFERRED EMBODIMENTS

Figure 1:
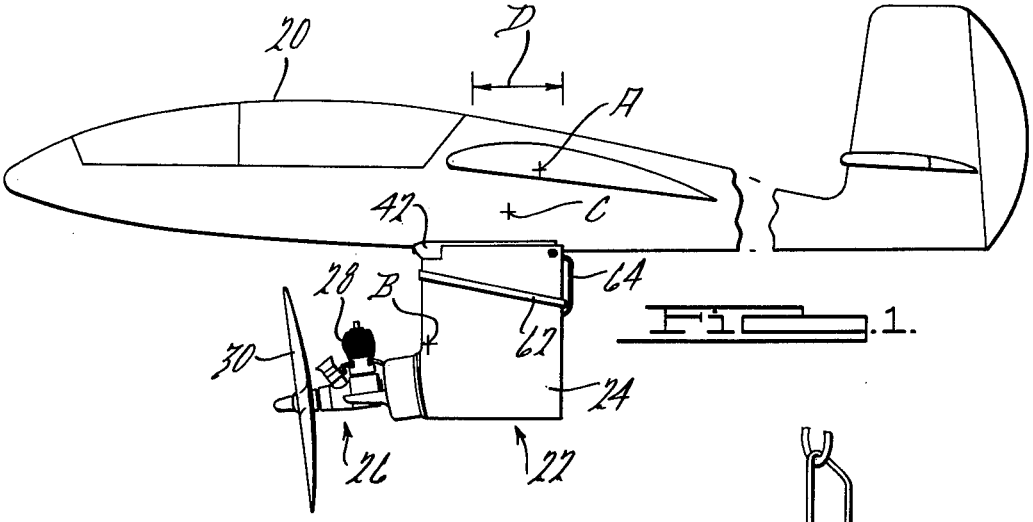
FIG. 1 is a side elevational view having a portion broken away of a model aircraft including a power pod constructed in accordance with the principles of the present invention.
Figure 14:
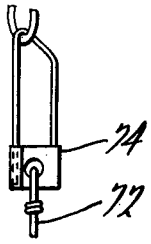
FIG. 14 is an enlarged view taken in circle 14 of FIG. 13.
Figures 2, 3, 4, 5, 6, 7, 8:
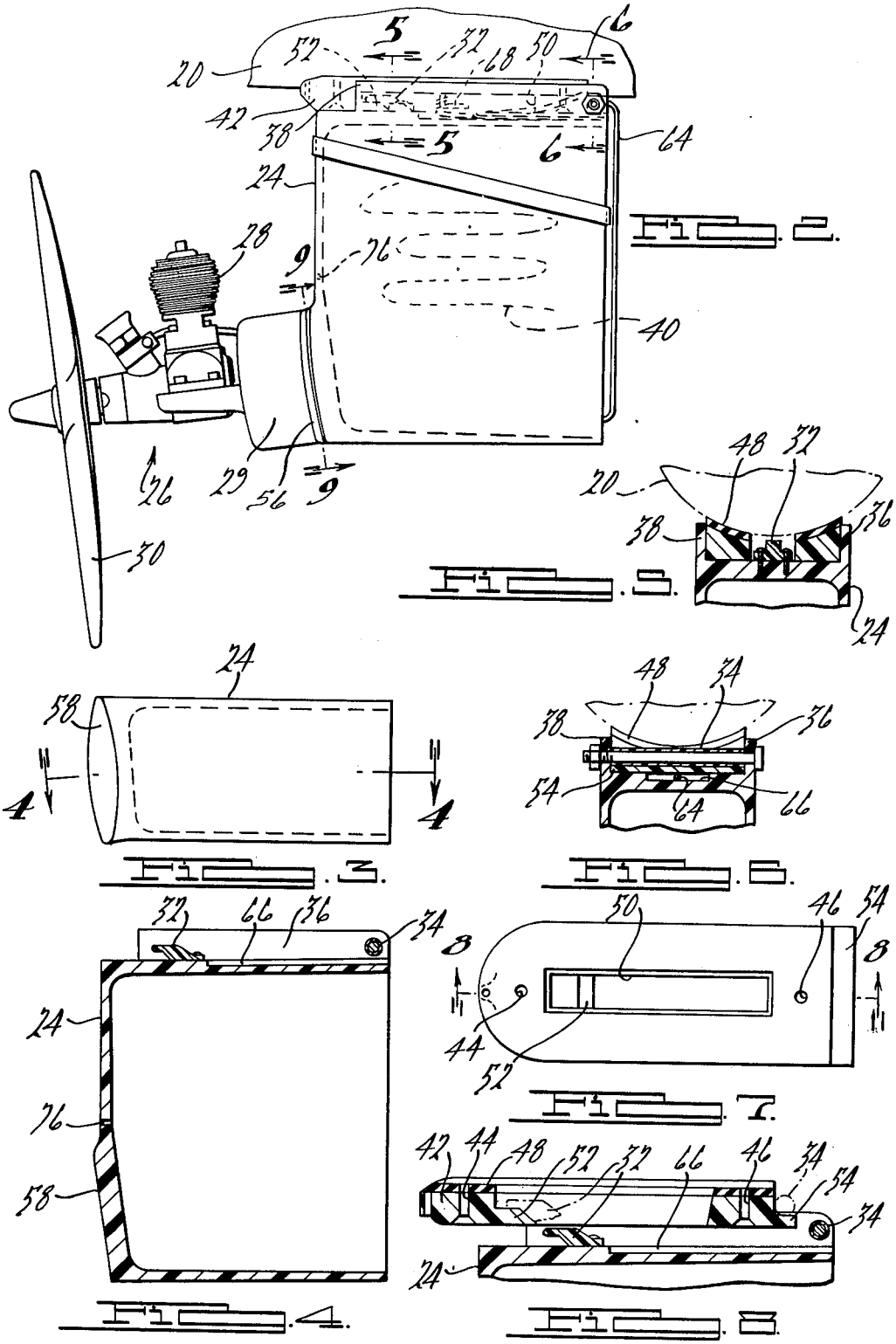
FIG. 2 is an enlarged side elevational view of the power pod shown in FIG. 1.
FIG. 3 is a bottom view of the power pod housing.
FIG. 4 is a vertical sectional view of the power pod housing taken in the direction of arrows 4—4 in FIG. 3.
FIG. 5 is a vertical sectional view taken in the direction of arrows 5—5 in FIG. 2.
FIG. 6 is a vertical sectional view taken in the direction of arrows 6—6 in FIG. 2.
FIG. 7 is a top view of the adaptor shown by itself, the adaptor being affixed to the model aircraft and the power pod being connectable with the adaptor.
FIG. 8 is a longitudinal vertical sectional view through the adaptor of FIG. 7, taken in the direction of arrows 8—8 and further illustrating the manner in which the power pod releasably coupled with the adaptor.

FIG. 1 illustrates a model glider plane 20 having a power pod 22 embodying principles of the present invention connected to the underside of the fuselage. Details of power pod 22 and the connection thereof with glider plane 20 can be seen in greater detail in FIGS. 2–8. Power pod 22 includes: a hollow, generally rectangular housing 24; a propulsion source 26 illustratively shown in the drawing as a singlecylinder engine 28 (for example, an engine of either 0.049–051 cubic inch displacement or 0.09–0.10 cubic inch displacement) and a propeller 30; a hook type lug 32 affixed to the top wall of housing 24 by a pair of fasteners; and a transverse support rod 34 extending between longitudinally extending side flanges 36 and 38 and affixed to flanges, 36 38 by means of a nut and bolt (see FIG. 6). A parachute 40 is contained in stored position within the interior of housing 24. As best seen in FIG. 4, the rear of housing 24 is open. Housing 24 is releasably coupled via lug 32 nd rod 34 with an adaptor element 42 which fixedly mounts to the underside of the fuselage of glider plane 20. Adaptor 42 may be conveniently affixed to the fuselage by passing fasteners through the longitudinally spaced holes 44 and 46 (FIGS. 7 and 8) in teh adaptor and into the fuselage or may be constructed as an integral part of the fuselage. The upper surface of adaptor 42 is contoured to approximately match the contour of typical glider plane fuselages, and according to one important aspect of the invention includes a layer 48 of a deformable, resilient material which is held compressed between adaptor 42 and the fuselage to permit the adaptor to fit snugly with the fuselage even though the contour of the upper surface of the adaptor and the corresponding surface of the fuselage may not exactly match. Accordingly, the adaptor if not built into the fuselage can fit a variety of different fuselage shapes which are presently commercially available in model aircraft. Adaptor 42 is further provided with an elongated rectangular opening 50 at the forward end of which is situated a ledge 52. A second ledge 54 is provided across the rear of adaptor 42. As best seen in FIG. 8, a power pod housing 24 releasably couples with adaptor 42. The solid line position of power pod housing 24 shown in FIG. 8 illustrates the relative positions of the pod and the adaptor preparatory to connecting the two, while the broken line position illustrates the coupled position. When the two are coupled, lug 32 rests on ledge 52 and rod 34 on ledge 54. As will be explained in greater detail hereinafter, power pod 22 remains coupled with adaptor 42 to power glider plane 20 into flight until the forward thrust of propulsion source 26 ceases. Thereafter, the power pod is permitted to separate from the adaptor and to fall away from the glider plane by force of gravity and drag. It will be noted in FIGS. 5 and 6 that power pod housing 24 has a generally snug fit with adaptor 42. It has been found that a snug fit is beneficial since it minimizes resonant vibrations during operation of propulsion source 26. However, when the power pod separates from the adaptor, it is desirable that resistance to separation be minimized. It is desirable to maintain as snug a fit as possible when the adaptor and the pod are connected in order to minimize vibration, yet it is desirable that resistance to separation be minimized to facilitate the pod disconnecting from the adaptor. With one aspect of the invention, the friction between the flanges 36, 38 and adaptor 42 is minimized by molding housing 24 and adaptor 42 from styrene and nylon, respectively, or other suitable polymeric materials, whereby to render these components tough and lightweight. If desired, the allowable tolerance between the adaptor and the pod could be reduced (i.e., a closer fit could be provided) if lubricant is used between the pod and the adaptor to facilitate separation of the pod from the adaptor when the forward thrust of propulsion source 26 ceases. This would tend to minimize vibration even further while still facilitating separation. Ledges 52 and 54 could incline downwardly and rearwardly, if desired.

A further feature of the invention relates to the manner in which the power pod 22 is located with respect to the glider. For purposes of illustration, let it be assumed that the location identified by the letter A in FIG. 1 designates the center of gravity (c.g.) of glider plane 20 without pod 22 and adaptor 42. Furthermore, let it be assumed that the location identified by the letter B designates the c.g. of the power pod and adaptor by themselves. The power pod and adaptor are mounted in relation to location A such that the resultant c.g. assumes a location identified by the letter C. According to many present glider designs, the resultant c.g. of the glider must fall within the design limits of each particular glider; for example, within the longitudinal range designated by the distance D in FIG. 1. The distance $d_2$ of the resultant c.g. at location C from location A can be determined according to the following formula:

$$d_2 = [M_1/M_1 + M_2] \times d_1$$

where:

$M_1$ = mass of pod and adaptor $M_2$ = mass of gliderplane $d_1$ = longitudinal distance between locations A and B (A minus B)

$d_2$ = longitudinal distance between locations A and C (A minus C)

After calculating the resultant c.g. C, it can be determined if this falls within the allowable range D. If so, the adaptor may be affixed to the fuselage in the particular location chosen. Alternatively, of course, the formula could be rearranged to determine the desired mounting location of the adaptor in order to produce a selected location for the resultant c.g.C. By way of example, the distance $d_1$ should be 2½–3¼ inches.

Figure 9:
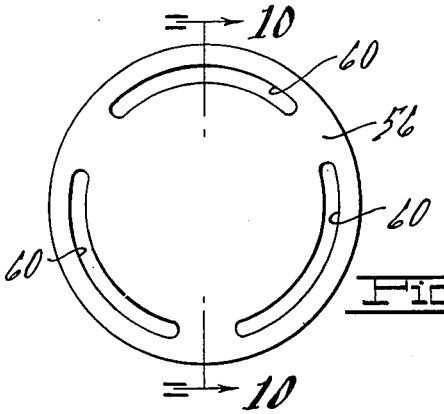
FIG. 9 is an enlarged sectional view taken in the direction of arrows 9—9 in FIG. 2.
Figure 10:
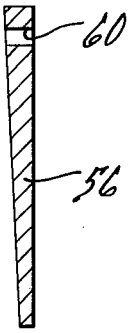
FIG. 10 is a vertical sectional view taken in the direction of arrows 10—10 in FIG. 9.

It will also be noted that, according to a further feature of the invention, the axis of engine 28, and hence the direction of thrust of propulsion source 26, inclines downwardly in the forward direction relative to the longitudinal axis of the glider. The thrust direction may be set to an optimum value by suitably positioning the engine on the pod through the use of a circular adjustment plate 56 which mounts between the integral engine fuel tank 29 and a circular mounting surface 58 provided at the lower end of the front wall of pod housing 24. Details of adjustment plate 56 are shown in FIGS. 9 and 10 wherein it can be seen that plate 56 has a wedge shape with the forward surface being inclined, by way of example, at approximately a 3° angle relative to the rear surface. At its narrowest point, the plate is, by way of example, approximately 1/16 inch thick. Plate 56 which may be advantageously molded from a suitable polymeric material includes a number of arcuately extending openings 60 corresponding to the mounting bolt pattern via which engine 28 mounts to pod housing 24. In the illustrated embodiment, three such openings 60 are provided to match the circularly arranged three-bolt pattern of the particular engine 28. Wigh adjustment plate 56 disposed between engine 28 and pod housing 24, the engine mounting bolts may be loosened to permit adjustment plate 56 to be adjusted over a range equal substantially to the arcuate extent of slots 60. It will be appreciated that, because of the wedge shape of the adjustment plate, the angle of the engine axis relative to the pod is thereby varied. In order to achieve a greater amount of adjustment, the engine mounting bolts can be removed and the adjustment plate can be indexed. In this way, the thrust angle of the engine can be set to an optimum value for the particular glider plane with which it is used. A 15° angle has been found suitable in one instance, although it will be appreciated that the angle will depend upon the mass of a particular glider plane and the thrust of a particular propulsion source.

Figure 13:
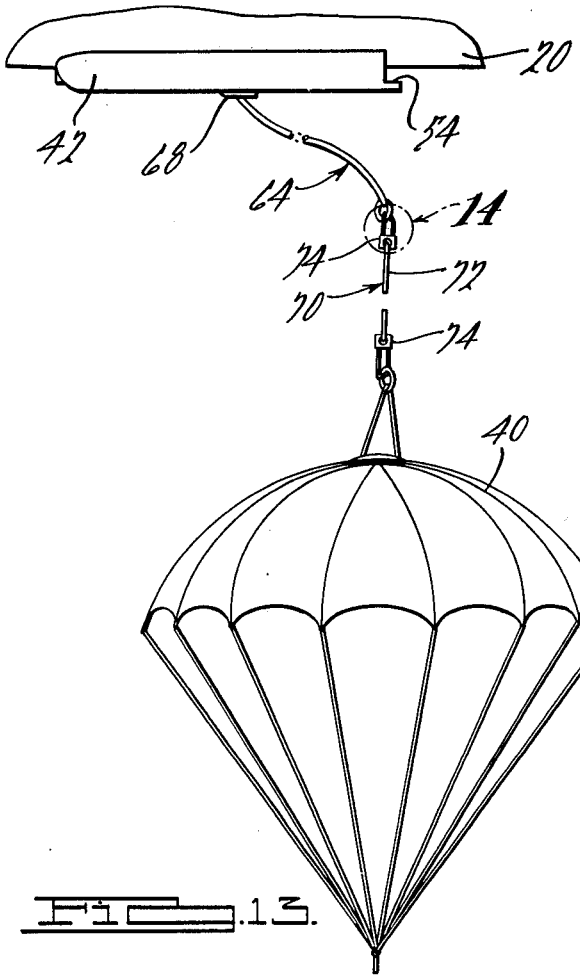
FIG. 13 is a view illustrating the initial deployment of the parachute from the power pod shortly after the power pod has separated from the aircraft.
Figure 15:
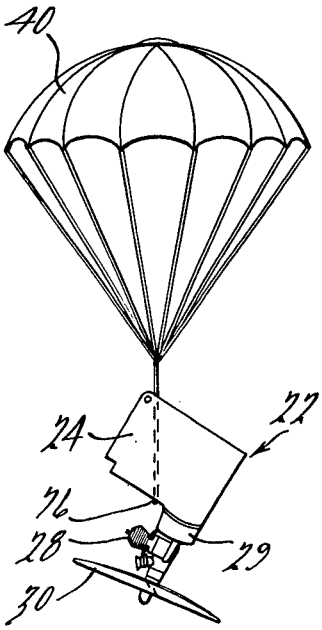
FIG. 15 is a view illustrating descent of the power pod after full deployment of the parachute.

Parachute 40 is suitably stored within pod housing 24 and it is intended to be deployed via the open rear end of the housing after engine 28 ceases to operate. It has been found desirable to place a rubber band 62 around the pod as indicated in FIG. 1 to prevent the parachute from prematurely deploying because of partial vacuum at the rear of the pod. A rip cord 64 has one end thereof connected to parachute 40 and extends beneath rubber band 62 as it exits from pod housing 24. The rip cord 64 extends upwardly around rubber band 62 and through a longitudinal channel 66 (see FIG. 6) provided in the top wall of pod housing 24. Channel 66 intercepts opening 50, and the end of rip cord 64 is securely attached to a tow hook 68 (see FIG. 2) customarily existing on the underside of the glider fuselage. Since tow hook 68 is customarily provided on many model aircraft of this type, the cutaway 50 serves to provide sufficient space to accommodate tow hook 68 when adaptor 42 is mounted on the fuselage. As best seen in FIG. 13, which shows how parachute 40 is deployed upon initial separation of the pod from the plane, rip cord 64 includes a replaceable, breakable link 70 consisting of a segment of relatively light cottom basting thread 72 (for example, a one-pound test has been found suitable) having a pair of closeable connector elements 74 at opposite ends, one connector element 74 connecting to parachute 40 and the other to a heavier segment of the rip cord which connects to the tow hook 68. This heavier segment could be, for example, 12-pound test line. Rip cord 64 is so constructed that, when power pod 22 initially separates from the glider, the portion of rubber band 62 extending across the open rear end of the pod housing is displaced from the opening to permit parachute 40 to be withdrawn from the housing. As the pod continues to fall away from the plane, rip cord 64 withdraws parachute 40 permitting the parachute to deploy. (It will be appreciated that, although FIG. 13 shows parachute 40 as being fully deployed while line 70 is still intact, such may not actually be the case since some time may be required for the parachute to completely fill with air.) As the pod continues to fall away, a point is reached where the rip cord becomes sufficiently taut that the breakable link 72 snaps. When this happens, the entire pod assembly and parachute is disconnected from the glider plane and can fall to earth as indicated in FIG. 15. With the aforementioned arrangement, it has been found that the separation of the power pod from the glider plane has a minimum effect on the glider plane.

In FIG. 15, it will be noted that parachute 40 is attached via a small attachment hole 76 in the front wall of the pod housing to permit the pod to fall to earth in approximately the orientation indicated in FIG. 15. Attachment hole 76 is approximately at the c.g. of the pod. By so controlling the orientation of the pod during its descent, the potential for damage to the pod upon impact with the ground is minimized because the pod will tend to land first on propeller 28, which is a sturdy plastic, and then either on the integral fuel tank 29 or the bottom front of the pod housing.

In light of the foregoing description, the advantages of the present invention can now be more fully appreciated. Prior to take-off, the operator will have set propulsion source 26 to provide optimum thrust angle for the particular glider plane with which the power pod is used. The operator does not have to go through the long and cumbersome procedure of setting up a tow cable and worrying about the direction of the wind. With the present invention, all that is necessary is that the operator couple power pod 22 with the glider plane 20 by engaging the power pod with the adaptor 42. The engine 28 is usual fashion. The operator can then head the glider plane into the prevailing wind and release the plane for take-off. Power pod 22 now propels the glider plane 20 into flight and can carry the plane until the supply of fuel contained within fuel tank 29 is exhausted. At this time, the propulsion source 26 ceases to provide a forward thrust to the glider. Accordingly, lug 32 and rod 34 fall rearwardly and downwardly off their respective ledges 52, 54 to separate the pod housing from the adaptor. Note that all this occurs by force of gravity and drag and without the need to have any additional ejection force, either explosive or otherwise. Although gravity provides the primary separation force, it will be appreciated that the drag of the pod could assist in separating the pod from the glider. As the power pod falls away from the glider plane, parachute 40 is deployed, the link 72 breaks, and the pod is thereafter gently carried to earth. The glider plane can now continue its flight at the pleasure of the operator. The pod is intended to be retrieved for reuse. In order to reuse the pod, only the broken link 72 need be replaced, and this can be done by disconnecting the connector elements 74 and reconnecting a complete new link 70. The parachute is then restored within the pod housing, and rubber band 62 is located on the pod as indicated in FIGS. 1 and 2.

Figure 11:
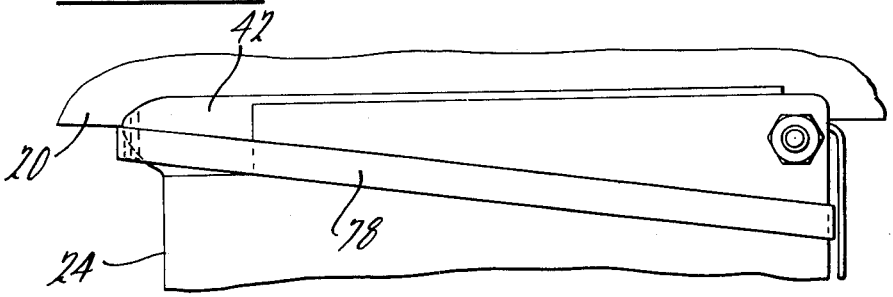
FIG. 11 is a view illustating a way to prevent the power pod from releasing from the model aircraft during flight, if such is desired.

In the event that it would be desired to keep the power pod connected with the adaptor during the entire flight of the glider even after the fuel supply is exhausted, an arrangement such as that shown in FIG. 11 can be used. In order to permanently couple the pod with the adaptor, a rubber band 78 can be placed around the pod housing and the adaptor such that the forward end of the rubber band extends across the front of the adaptor and the rear of the rubber band extends across the upper portion of the open rear end of the pod housing. In this manner, rubber band 78 exerts a sufficient force on the pod assembly which cannot be overcome when operation of engine 28 ceases. Hence, lug 32 and rod 34 cannot fall off of the respective ledges 52 and 54, and this maintains the power pod connected with the glider plane during the entire flight of the glider plane.

Figure 12:
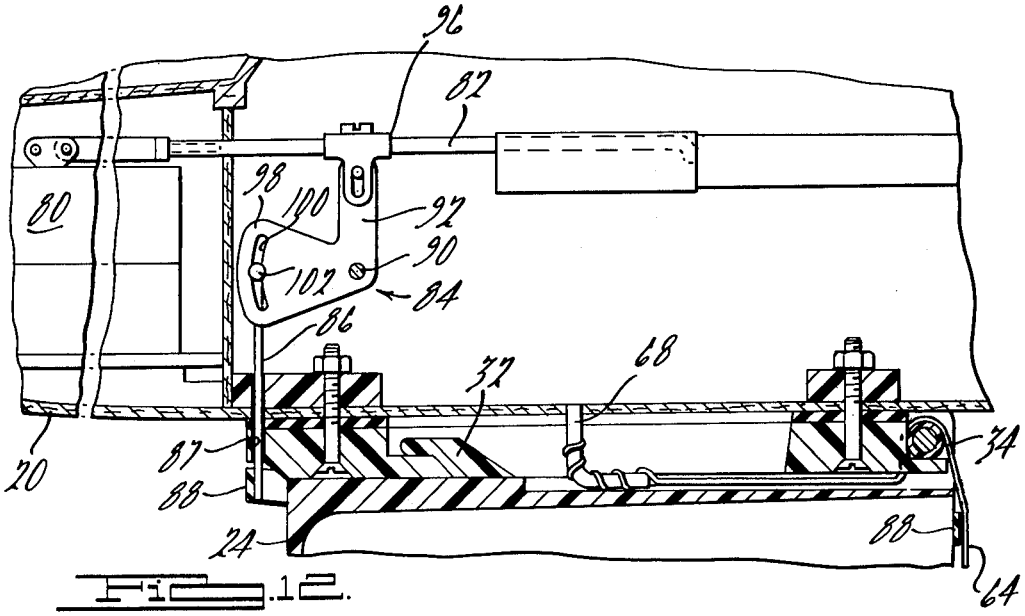
FIG. 12 is a fragmentary vertical sectional view illustrating another embodiment of the invention.

FIG. 12 discloses a further embodiment of the invention wherein power pod 22 can be released at the command of a remote control radio signal supplied from the ground. Since many glider planes can be flight-controlled from the ground by operator-directed command signals, this embodiment of the present invention takes advantage of the existing servo flight control mechanism already existing in the model glider. Briefly, one exemplary existing servo control mechanism includes a servo 80 which operates a control rod 82 to adjust control surfaces in the tail section of the plane. Servo 80 is capable of longitudinally displaceing control rod 82 over a range of position to thereby position the glider control surfaces over a range of positions. The servo 80 is actuated in conventional fashion in response to remote control radio signals supplied from the ground by an operator-controlled transmitter. Thus, the servo 80 and the control rod 82 typify existing radio controlled mechanism contained in the glider plane. Pursuant to this embodiment of the invention, a bell crank mechanism 84 is added to the existing control. Bell crank mechanism 84 provides an operative coupling between control rod 82 and a vertical pin 86 to release a rubber band 88 when it is desired to release the power pod from the glider. Pin 86 is guided through a vertical hole 87 in the forward end of adaptor 42 and through an aligned opening provided in the glider fuselage structure. Basically, rubber band 88, when in the position shown in FIG. 12, performs the same function as rubber band 78 in FIG. 11 in that the power pod is held connected with adaptor 42. However, when pin 86 is displaced upwardly and released from rubber band 88, rubber band 88 snaps onto the forward end of the pod and thereby ceases to exert a force holding the pod in engagement with the adaptor. At this time, the pod will fall away and separate from the glider plane as described in connection with the preceding embodiment. Bell crank mechanism 84 operates pin 86 as follows. Bell crank 84 is arranged to pivot about an axis 90 and has one lever arm 92 connected via a slot and pin with a collar 96 positioned on control arm 92 by means of a set screw. The other lever arm 98 of the bell crank includes an arcuate slot 100 which engages a right angle bend 102 at the upper end of pin 86. The bell crank mechanism is arranged in relation to the displacement of control rod 82 such that over a fraction of the total travel of control rod 82, bend 102 simply rides within groove 100. However, when control rod 82 is displaced rearwardly beyond this fraction of control rod travel, the end of groove 100 hits bend 102 and thereafter lifts pin 86 upwardly. With pin 86 displaced upwardly, rubber band 88 is released and the pod can now fall away from the glider plane. It has been found that with the typical remote-control-type glider the operator can readily learn to command displacement of control rod 82 to a position sufficient to release rubber band 88 without significantly affecting the flight of the glider plane. Thus, the operator on the ground can release the pod from the glider at any desired time in flight after engine 28 stops. It is hereby understood that the illustrated bell crank arrangement is merely exemplary and that other forms of mechanism for releasing pin 86 in response to predetermined command signals from the operator could be used.

Figure 16:
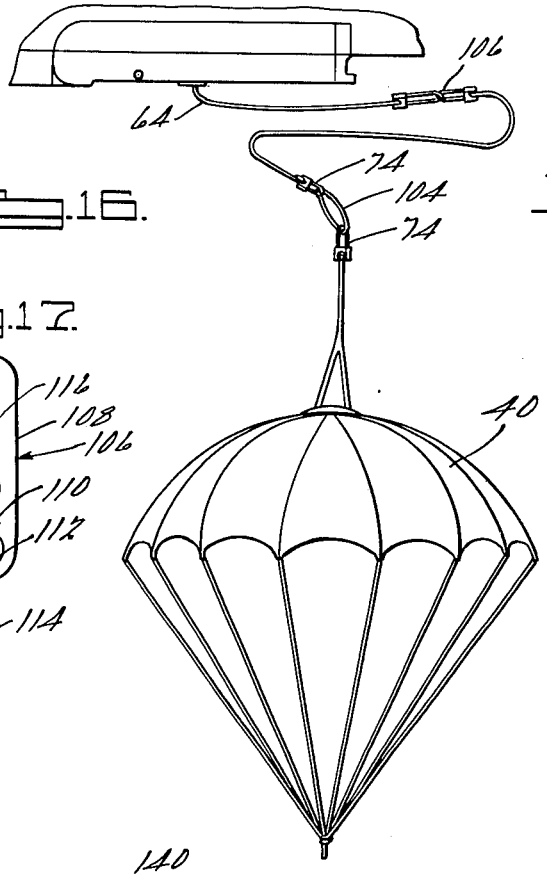
FIG. 16 is a view of structure similar to that shown in FIG. 13 with a shock absorber applied thereto.

In FIG. 16, the parachute 40 is shown in fully extended position when supporting the pod 24, as illustrated in FIG. 15. The parachute has a connecting element 84 at the top and the rip cord 64 has a similar connecting element 74 on its end joined by a rubber band 104 which functions as a shock absorber to take up any initial shock which would cause the separation of the parachute from the rip cord 64 before the parachute has fully separated from the pod. The rubber band is readily interchangeable so that different rubber bands will provide different shock absorbing forces. A breakable link 72 may be employed between the rubber bank 104 and the rip cord 64 to be broken after the parachute has completely moved from the pod. Preferably, a time delay mechanism 106 is employed between the rubber band 104 and the rip cord 64.

Figure 17:
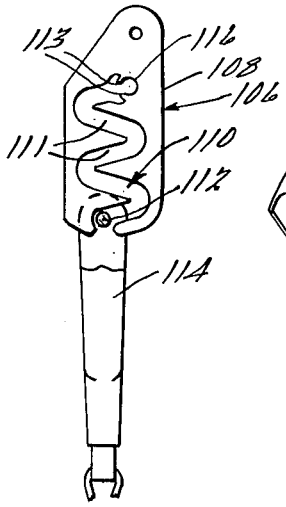
FIG. 17 is a view of a time delay device which retards the separation of the parachute from the glider.

Instead of the breakable link 72, a time delay mechanism 106, as illustrated in FIG. 17, may be used to effect diployment of the parachute. The mechansm 106 is shown as comprising a flat strip 108 having a sinuous slot 110 with the runs 111 disposed at an angle of substantially 30°. A pin 112 at the bifurcated end of an element 114 extends through the slot 110 and delays the separation of the bifurcated element 114 from the flat strip 108 as the pin passes along the slot. A recess 116 may be provided at the upper end of the slot 110 for the pin 112 having forwardly thereof inwardly directed abutments 113 which are deflectable to provide a detent and release the pin with a delayed action as a result of a slight positive pull on the element 114 to produce separation between the element 114 and strip. The time it takes for the separation and movement of the pin 112 from the slot 110 is slightly more than that required to make certain that the pod has fallen a sufficient distance to have the parachute pulled completely therefrom, and the length of the slot 110 and magnitude of the angles of the runs 111 may be varied to achieve the desired time delay.

Figure 18:
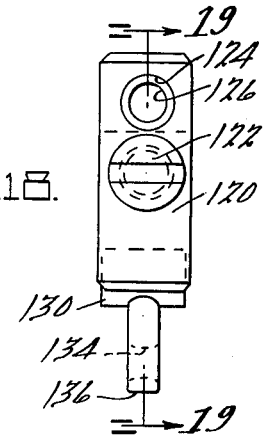
FIG. 18 is a sectional view of another form of time delay device.
Figure 19:
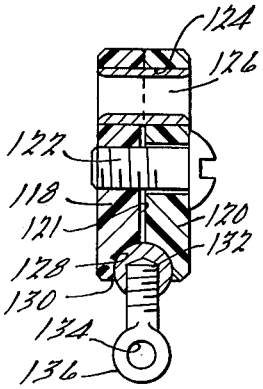
FIG. 19 is a side view of the structure illustrated in FIG. 18.

Another alternative to the breakable link 72 or mechanism 106 is shown in FIGS. 18 and 19, wherein a release mechanism is illustrated as consisting of two longitudinal strips 118 and 120 which are secured together by a screw 122. The strips have an aperture 124 therethrough containing a metal bushing 126 to which the fitting 74 is secured adjacent to the shock absorber 104. A cylindrical aperture 128 is provided at the opposite end of the strips 118 and 120 with the upper portion cut away and relieved at 130. A separable cylindrical element 132 is supported in said cylindrical aperture 128 and retained therein under a variable release pressure obtained by tightening or loosening the screw 122 to move the strips 118 and 120 toward and away from each other, a slot 121 being provided between said strips. The hole 134 in the eye 136 carried by the cylindrical element 132 is secured to the fitting 74 secured to the free end of the rip cord 64. The advantage of this type of mechanism over the time delay mechanism 106 resides in the adjustment which requires different forces for separation.

Figure 20:
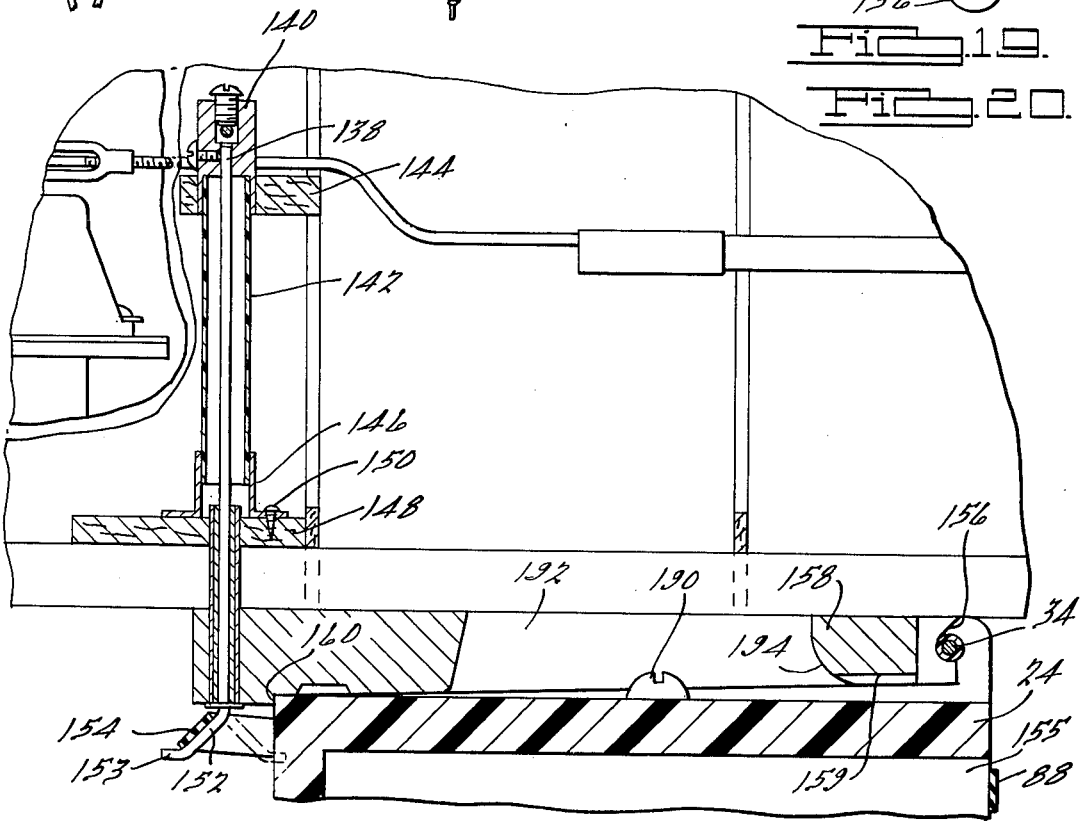
FIG. 20 is a sectional view of structure, similar to that shown in FIG. 12, showing a further form of the invention.

Referring to FIGS. 20 to 23, applicant has illustrated a positive force for initially moving the pod for separation from the glider plane. In this relationship, the rotatable rod 138 is mounted on a head 140 which has a rubber tube 142 fixedly secured thereto and mounted in an element 144 for rotation. The lower portion of the tube 142 is secured to a cylindrical end 146 which is attached to a fixed element 148 by a plurality of screws 150. The lower end 152 of the rod 138 is disposed at an angle of approximately 45° for supporting the end 154 of the rubber band 88 which is disposed about the pod 24. In FIG. 20, the pod is illustrated as carrying a transverse support rod 34 which is secured within a notch 156 in an adaptor 158 attached to or formed in the fuselage of the glider plane. The opposite end of the pod is disposed adjacent to a recessed shoulder 160 and is retained in the forward position by the rubber band 88.

Figure 21:
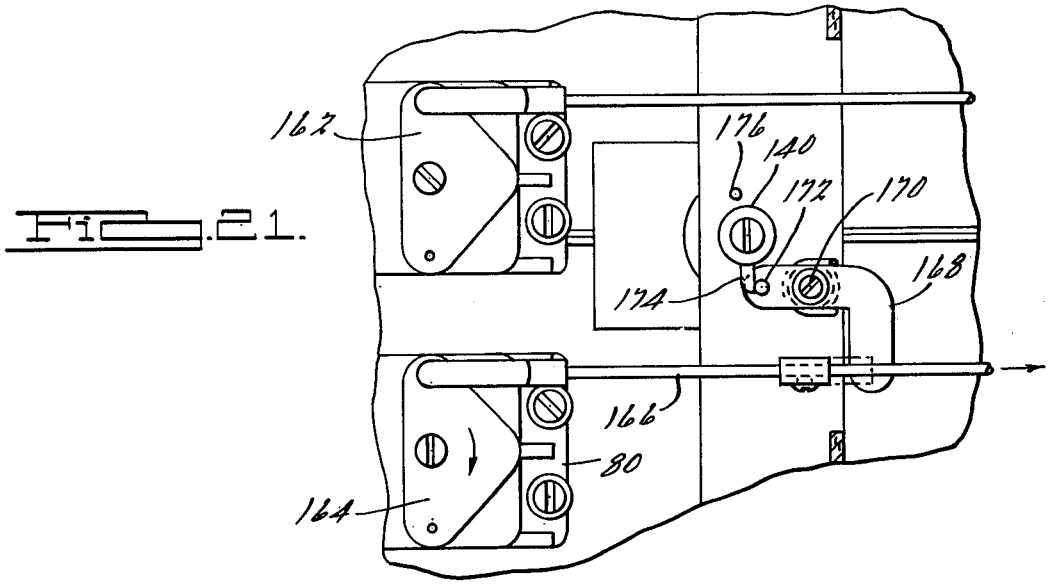
FIG. 21 is a plan view of the structure illustrated in FIG. 20.
Figure 22:
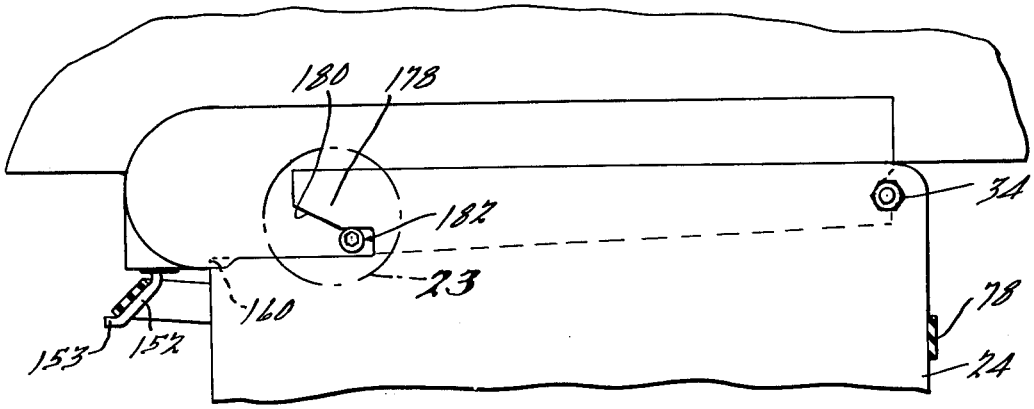
FIG. 22 is a view of structure similar to that illustrated in FIG. 20 showing a further form thereof.
Figure 23:
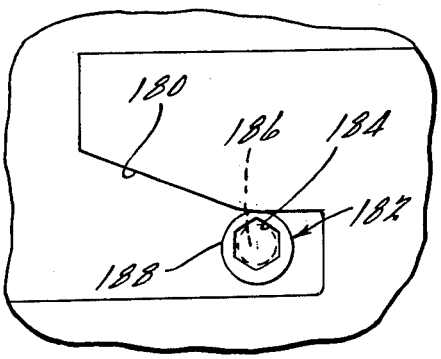
FIG. 23 is an enlarged view of the lefthand adjustable supporting head illustrated in FIG. 22.
Figure 24:
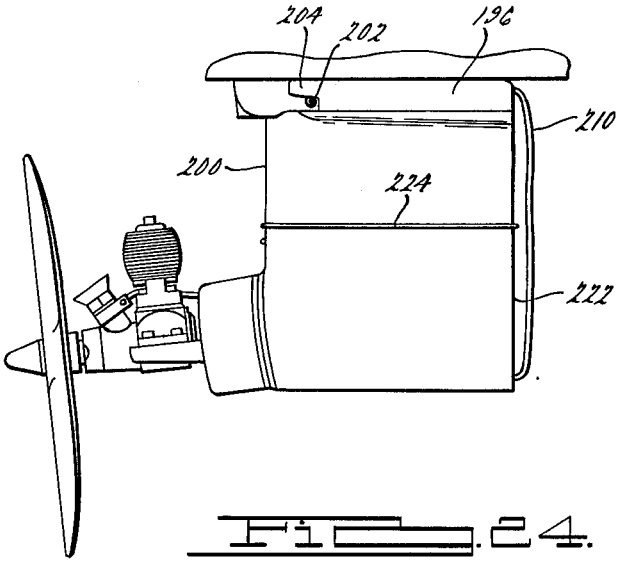
FIG. 24 is a view of a pod with a new type of adaptor shown on a fuselage providing a releasable support which is similar to that illustrated in FIG. 1.

As illustrated in FIG. 21, a pair of radio controlled actuating mechanisms 162 and 164 are provided within the fuselage above the pod for controlling the flight of the glider plane when the pod is released therefrom. While the propeller 30 is rotating, the glider plane will be carried aloft until sufficient time has passed, usually that required to use up the fuel for driving the engine when the pod is released. The mechanism 164 is actuated to move a rod 166 forwardly and backwardly to control one phase of the flight of the glider plane. The rearward movement of the rod will turn a bell crank 168 counterclockwise about a pivot 170 to move a pin 172 out of the path of a pin 174 which extends from one side of the collar 140. The pin 174 will be revolved until it strikes a fixed projecting pin 176 to limit the rotation of the tube 142. After the pin 174 strikes the pin 176, a substantial degree of windup remains in the tube 142 so that the force exerted when the pin 174 is moved against the pin 176 will be substantial amount. When the head 140 is thus rotated, the end 152 of the rod 138 will move to the dot and dash line position of FIG. 20 in which position the rubber band 154 is released from the end 152 and the end strikes the forward end of the pod 24 to push it to the rear. The end 152 of the rod 138 has its tip 153 bent at an angle of 45° to strike the pod at right angle and to assure the separation of the rubber band 154 therefrom.

The initial rearward movement of the pod 22 carries the transverse rod 34 rearwardly along therewith in the notch 156 and causes it ot ride up the 45° incline at the top of the notch. The rearward slightly upward movement of the rod 34 moves the 30° sloping edge 180 on the socket head screws away therefrom so that both ends of the pods 24 will separate from the adaptor in a counterclockwise movement caused by the preponderance of weight at the point of center of gravity B, as illustrated in FIG. 1. In other words, because the center of gravity of the pod is forward of the screws 182, there exists a force which assists gravity and drag in effecting separation of the pod from the adaptor. As the pod starts to fall, the rip cord 64 retains connection with the parachute 40 and pulls it from the interior of the pod 24. The rip cord 64 is disposed in a slot 159 in the rear bottom face of the adaptor 158 in position to extend over the rod 34 to prevent any tangling of the cord. A screw head 190 is provided at the top of the pod 24 which extends within a slot 192 in the adaptor 158 in position to strike an arcuate surface 194 at the rear end of the slot for deflecting the pod downwardly away from the rear end of the plane to prevent it from striking and cause damage thereto when the pod 24 is separated from the adaptor 158.

It is pointed out that the adaptor while illustrated and described as a separate unit may be constructed integral with the bottom of the fuselage and that the engine need not have its thrust line disposed at a 50° angle in all circumstances.

After separation, the pod 24 will be gently lowered to the ground by the parachute and the glider plane will glide under the control of the radio impulses actuating the mechanisms 162 and 164.

The notches 180 at the forward edge of the pod 24 which are engaged by a pair of heads 182 of socket head screws have the axis of a hexagon recess 184 aligned with that of the threaded body 186. As illustrated in the Figures, the heads 182 have an outer surface 188 which is eccentrically disposed relative to the axis of the threaded body and the hexagon recess 184 so that upon turning the screw, a variable and adjustable clearance can be provided between the pod 24 and adaptor 158 so that the pod is free to move to the right in FIG. 20, i.e., toward the rear of the aircraft. This eliminates any friction which could otherwise exist and assures the immediate separation of the pod from the glider plane when the rod 138 is rotated.

A further embodiment of the invention is illustrated in FIGS. 24 to 27 wherein an adaptor 196 is attached to the bottom of the fuselage in the manner as hereinabove described. The adaptor has a central slot 197 and a rear cam surface 199 against which a projection 198 at the top of a pod 200 strikes to be deflected downwardly away from the fuselage and tail structure of the model glider plane 20. The forward end of the adaptor is provided with outwardly projecting trunions 202 over which fingers 204 on opposite sides of the pod 200 extend being locked therein by recesses 206 at opposite rear sides of the adaptor 196 which extends over a forwardly projecting flange 208 at the rear of the pod. At a signal from the ground or upon the stopping of the engine carried by the pod, the pod moves rearwardly disconnecting the flange 208 from the recesses 206 while the fingers 204 move to the right and separate from the trunions 202 to permit the pod to start falling to the ground. When so released, a rip cord 210 connected to the fuselage or the adaptor 196 withdraws a parachute 212 from the rear open wall 222 of the pod.

Figure 26:
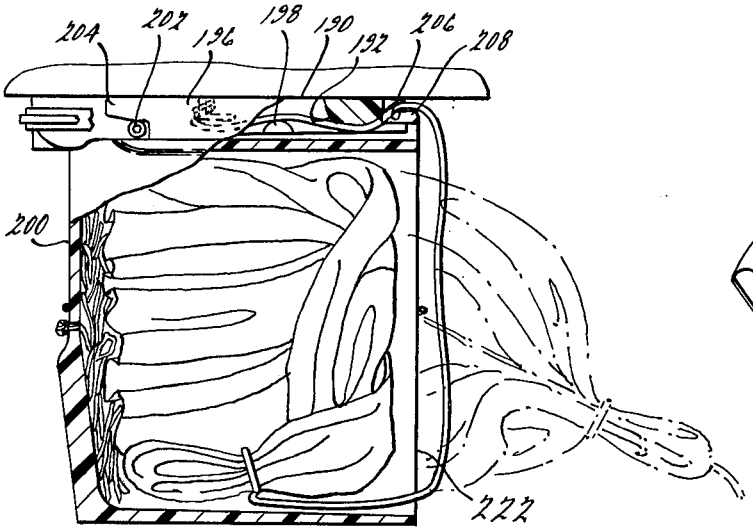
FIG. 26 is a view of a cord which is attached to the fuselage which has a frictional engagement with the parachute which permits the parachute to be withdrawn and separate from the cord.

The connection between the rip cord 210 and the parachute 212 is a frictional one produced, in the illustrated emebodiment, by a ring 214 which is attached to the rip cord 210 to have frictional engagement with the parachute. The ring is of light weight preferably being made of a plastic material which has releasable frictional engagement with the central part of the cloth of the parachute canopy. The canopy 216 of the parachute has a plurality of shroud lines 218 extending downwardly from the bottom edge thereof which are connected at their free ends to a cord 220 which, as pointed out hereinabove, extends through an aperture at the center of gravity of the pod and the engine attached thereto for controlling the fall and the position thereof when striking the ground. When storing the parachute within the interior of the pod, the shroud lines 218 are first inserted in the open rear face 222 of the pod followed by the lower portion of the canopy with the central portion thereof extending from the opening as shown in dot and dash line in FIG. 26. The extending portion of the parachute and the engaged ring is then folded over and tucked within the pod at the interior lower portion thereof, as best seen in FIG. 26.

Figure 25:
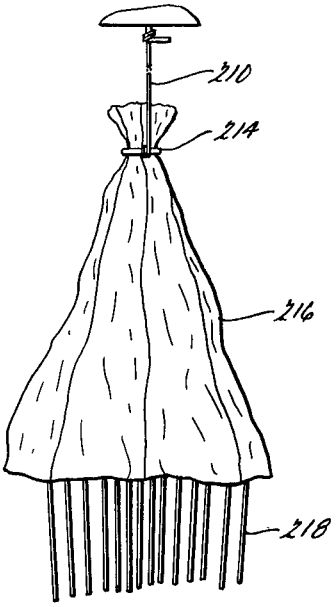
FIG. 25 is an enlarged sectional view of the pod illustrated in FIG. 24, showing the parachute packed on the interior thereof.
Figure 27:
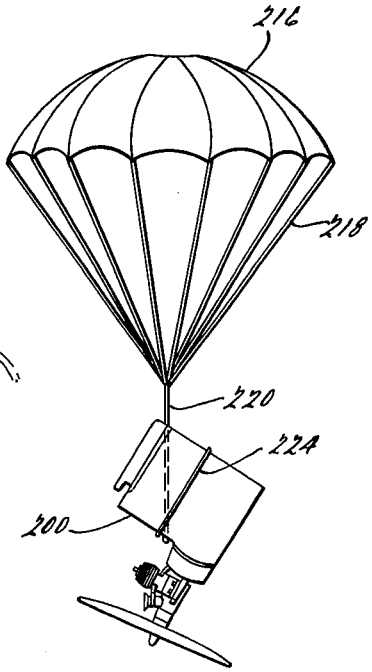
FIG. 27 is a view of the parachute supporting the pod as it descends after being separated from the adaptor.

The friction engagement is such that when the pod 200 is separated from the adaptor 196, the rip cord 210 will withdraw the ring 214 and the central portion of the parachute canopy 216 therewith so that it will be suspended from the fuselage or the adaptor in a manner illustrated in FIG. 25. The friction between the ring 214 and the cloth of the canopy is such that the ring will not separate when withdrawing the parachute. As the pod continues to fall, the force exerted on the shroud lines and canopy when the fall is stopped thereby will be such that the central portion of the canopy separates and the parachute will deploy, as illustrated in FIG. 27, and bring the pod, engine and propeller safely to the ground. After the parachute is stored within the pod, a rubber band 224 is placed around the pod to extend over the open face thereof and prevent the inadvertent movement of the parachute therefrom. The frictional engagement between the ring and the parachute permits the reconnection of the parachute to the ring when the pod is assembled on the adaptor so that the plane may again be launched into the air.

While a ring of friction material which is light in weight describes the element which frictionally engages the parachute, it is to be understood that such an element need not be circular and could be made of other materials and be a clamping spring which provides a holding force which can withdraw the parachute from the pod and will permit the falling pod to withdraw the parachute therefrom when applying a sudden pulling force thereto. The use of the frictional engagement between the parachute and the element on the end of the rip cord is a positive means for withdrawing the parachute and separating it from the plane. When the element and center of the parachute is tucked into the top of the pod, as above described, the initial pull of the element as viewed in FIG. 26 will be in a direction to force the element further on the parachute as the initially applied force pulls it from the pod. The use of the element permits a reconnection between the rip cord and the parachute so that the plane can again be launched in the air with the assurance that the parachute will be withdrawn from the pod and will be disconnected by the sudden pull exerted thereon by the falling pod.

From the foregoing detailed description, it can be seen that the present invention provides important benefits and advantages for model aircraft enthusiasts which promote their enjoyment of their hobby. While it will be apparent that the preferred embodiments illustrated herein are well calculated to fulfill the objects above stated, it will be appreciated that the present invention is susceptible to modification, variation, and change without departing from the scope of the invention as defined by the appended claims.

What is claimed is:

1. A power pod for an aircraft having a fuselage, propulsion means on said pod to provide forward thrust to said glider plane, coupling means for releasably securing said pod to said fuselage, means causing the release and separation of said pod from said coupling means, a parachute within the pod, a supporting cord connected to the coupling means and fuselage, and a friction member on the supporting cord defining a portion which has friction engagement with the parachute sufficient to withdraw the parachute from the pod and permit the pod and propulsion means to pull the parachute from the friction member and separate it from the glider plane.

2. A power pod for an aircraft as recited in claim 1, wherein said coupling means embodies an adaptor securable to the underside of the fuselage, said adaptor having supporting means at both ends, and means on the upper face of said pod which engage the end support means of the adaptor when biased forwardly thereon.

3. A power pod for an aircraft as recited in claim 2, wherein said parachute has a cloth body and shroud lines, and means for connecting the shroud lines to the inside of the pod where the parachute is stored.

4. A power pod for an aircraft as recited in claim 2, wherein the fall of said pod from the adaptor pulls the parachute from the pod and the friction member from the parachute.

5. A power pod for an aircraft as recited in claim 4, wherein the friction member is a ring having a predetermined internal diameter.

6. A power pod for an aircraft as recited in claim 5, wherein the shroud lines and adjacent parachute portion are first inserted into the pod after which the ring frictionally engaging the center of the parachute is reversely folded and moved into the pod.

7. A power pod for an aircraft as recited in claim 6, wherein a rubber band around the pod extends over its open face for preventing the parachute from being inadvertently withdrawn therefrom.

8. A power pod for an aircraft as recited in claim 7, wherein the ring is of light weight and made from a durable plastic material.

9. A power pod for an aircraft as recited in claim 1, wherein the pod is released from the coupling means at the time the propulsion means ceases to operate.

10. A power pod for an aircraft as set forth in claim 1 wherein said portion of said friction member defines an opening, the periphery of which is frictionally engaged with said parachute.

* * * * *